United States Patent [19]

Midolo

[11] 4,187,694

[45] Feb. 12, 1980

[54] BINARY WORKING FLUID AIR CONDITIONING SYSTEM

[76] Inventor: Lawrence L. Midolo, 1475 Black Oak Dr., Centerville, Ohio 45459

[21] Appl. No.: 962,742

[22] Filed: Nov. 21, 1978

[51] Int. Cl.[2] ..... F25D 9/00

[52] U.S. Cl. ..... 62/402; 62/323; 123/119 CD; 60/618

[58] Field of Search ..... 62/402, 323; 123/119 CD; 60/618

[56] References Cited

U.S. PATENT DOCUMENTS

| | | | |
|---|---|---|---|
| 3,228,189 | 1/1966 | Baker | 60/618 |
| 3,252,298 | 5/1966 | Andrews | 62/402 |
| 3,350,876 | 11/1967 | Johnson | 60/618 |
| 3,668,884 | 6/1972 | Nebgen | 62/402 |
| 3,713,294 | 1/1973 | Balje et al. | 62/402 |
| 3,830,062 | 8/1974 | Morgan et al. | 60/618 |
| 3,967,466 | 7/1976 | Edwards | 62/402 |
| 3,968,649 | 7/1976 | Edwards | 62/402 |
| 4,017,285 | 4/1977 | Edwards | 62/402 |
| 4,069,672 | 1/1978 | Milling | 60/618 |

*Primary Examiner*—Ronald C. Capossela

*Attorney, Agent, or Firm*—Joseph E. Rusz; Richard J. Killoren

[57] ABSTRACT

An air conditioning system for vehicles having a reverse Brayton cycle cooling system with a turbine drive for the rotor in the reverse Brayton cycle cooling system. A binary working fluid is used in the air conditioning system with air used in the reverse Brayton cycle cooling system. Waste heat is used to provide superheated water vapor for driving the turbine with the turbine return supplied to the air flow at the outlet of the compressor of the cooling system. The combined working fluid is supplied to a heat rejection heat exchanger where the excess water vapor is condensed and returned to the waste heat recovery system.

9 Claims, 4 Drawing Figures

BINARY WORKING FLUID AIR CONDITIONING SYSTEM

RIGHTS OF THE GOVERNMENT

The invention described herein may be manufactured and used by or for the Government of the United States for all governmental purposes without the payment of any royalty.

BACKGROUND OF THE INVENTION

This invention relates to an air conditioning system for vehicles.

The U.S. Pat. Nos. to Baker, 3,228,189; Andrews, 3,252,298; Johnson, 3,350,876; Balje et al, 3,713,294; Morgan et al, 3,830,062; Edwards, 3,968,649 and Milling, 4,069,672 disclose waste heat recovery systems for internal combustion engines. The U.S. Pat. No. to Edwards, 3,967,466 discloses an air and waste vapor reverse Brayton cycle air conditioning system.

BRIEF SUMMARY OF THE INVENTION

According to this invention a condensible working fluid is used to extract waste heat from the engine exhaust, hot engine oil or other engine waste heat sources of an internal combustion engine to drive a turbine. The turbine is used to drive a reverse Brayton cycle cooling system. The superheated working fluid is expanded down to a lower temperature and pressure in the turbine and is then supplied to the output of the compressor of the reverse Brayton cycle cooling system. The return from the turbine and the output of the compressor is then passed through a heat rejection heat exchanger where the excess water vapor is condensed and returned to the waste heat recovery system.

IN THE DRAWINGS

DETAILED DESCRIPTION OF THE INVENTION

Figure 1:
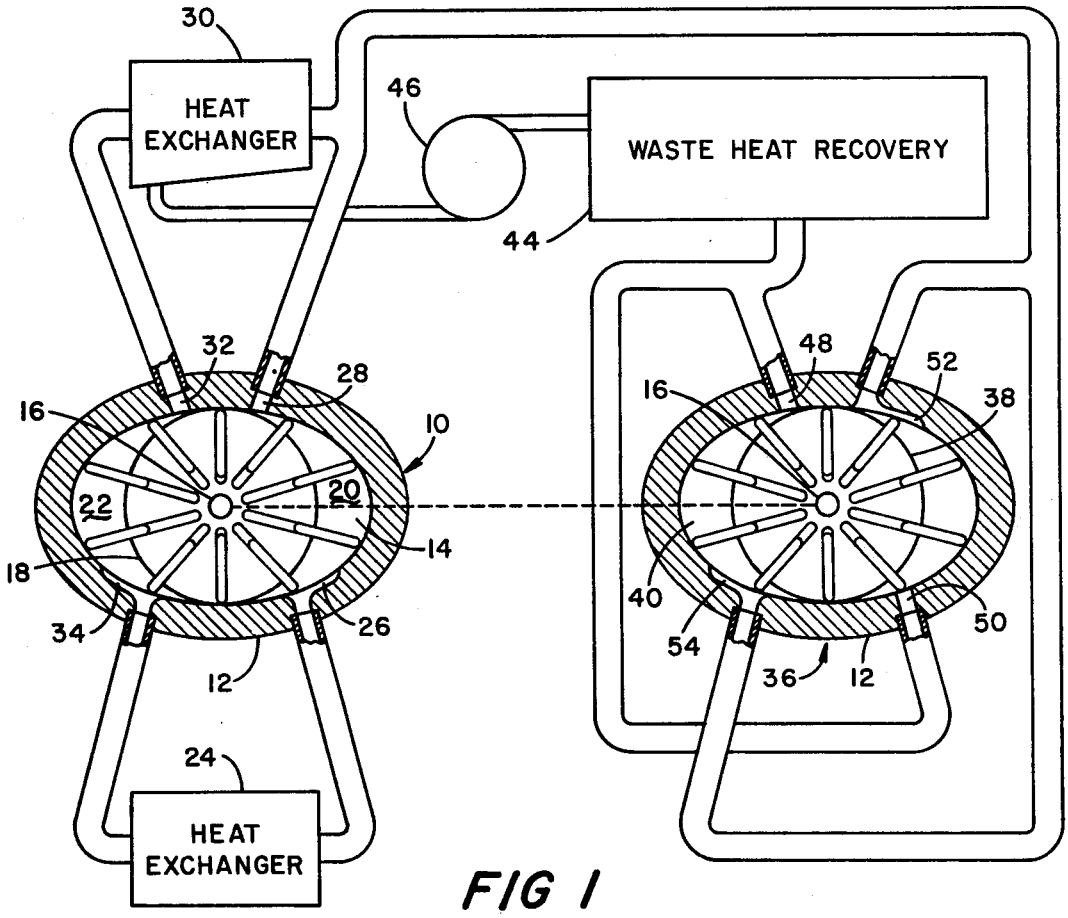
FIG. 1 is a schematic diagram, partially in block form showing a reverse Brayton cycle cooling system with a turbine drive according to the invention.

Reference is now made to FIG. 1 of the drawing which shows a conventional reverse Brayton cycle cooling system 10 having a housing 12 including a chamber 14. The cooling system includes a compressor and an expander driven by a common shaft 16. The compressor and expander include a sliding vane rotor 18 positioned within chamber 14 with a compressor section 20 on one side of the rotor and an expander section 22 on the other side of the rotor.

Air from the heat exchanger 24, which supplies cooling for the passenger compartment of a vehicle, is supplied to the compressor inlet 26. The compressed air at outlet 28 is supplied to a heat rejection heat exchanger 30 which would normally be air cooled. The output of the heat exchanger 30 is supplied to the expander section 22 through inlet 32. The cooled air at the outlet 34 is supplied to the heat exchanger 24 as in a conventional reverse Brayton cycle cooling system which runs on a conventional reverse Brayton cycle as shown in the pressure-enthalpy diagram in FIG. 3.

The rotor 18 is driven by a turbine 36 having a sliding vane rotor 38 within a chamber 40 and connected to shaft 16. The chamber 40 can be located within housing 12 with a wall, not shown, separating chambers 14 and 40. The shaft 16 would pass through the wall between chambers 14 and 40 with seals, not shown, provided as required. For some applications separate housings for the cooling system and the drive turbine may be desired. Also other low speed turbines than that shown could be used.

The turbine is driven by superheated steam from a waste recovery system 44. Water condensed in heat exchanger 30 is pumped into the waste heat recovery system 44 by a pump 46. Superheated steam from the waste heat recovery system 44 is supplied to inlets 48 and 50 of the turbine 36. The output, from turbine outlets 52 and 54, is mixed with the output 28 of compressor 20 and supplied to the heat exchanger 30. The saturated steam from the turbine is added to the unsaturated air at the output of the compressor and the combination passes through the heat exchanger 30 wherein the excess water vapor is condensed with the condensate collecting in the heat exchanger. The water in the heat exchanger is returned to the waste heat recovery system 44 by pump 46.

Figure 2:
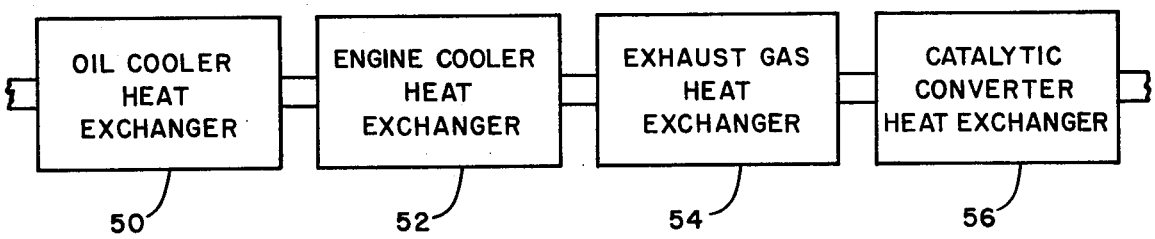
FIG. 2 is a block diagram showing one possible waste heat recovery system which can be used in the device of FIG. 1.

The waste heat recovery system 44 includes one or more heat exchangers shown in FIG. 2. The water from pump 46 is supplied to an oil cooler heat exchanger 50 and then to an engine cooler heat exchanger 52, which can be the water jacket of the engine. The water from heat exchanger is converted to superheated steam in the exhaust gas heat exchanger 54. The steam leaving the exhaust gas heat exchanger can be raised to a higher temperature in the catalitic converter heat exchanger 56 before application to the turbine 36. While water and air have been described as the working fluids, other combinations of condensible and non-condensible working fluids can be used for certain applications. For the purpose of this application, a condensible working fluid is defined as a fluid which will change its phase from gas to liquid and vice versa within the temperature and pressure ranges of 100° F. to 450° F. and 1 psia to 450 psia, respectively. A non-condensible working fluid remains a gas over the same temperature and pressure range.

Figure 3:
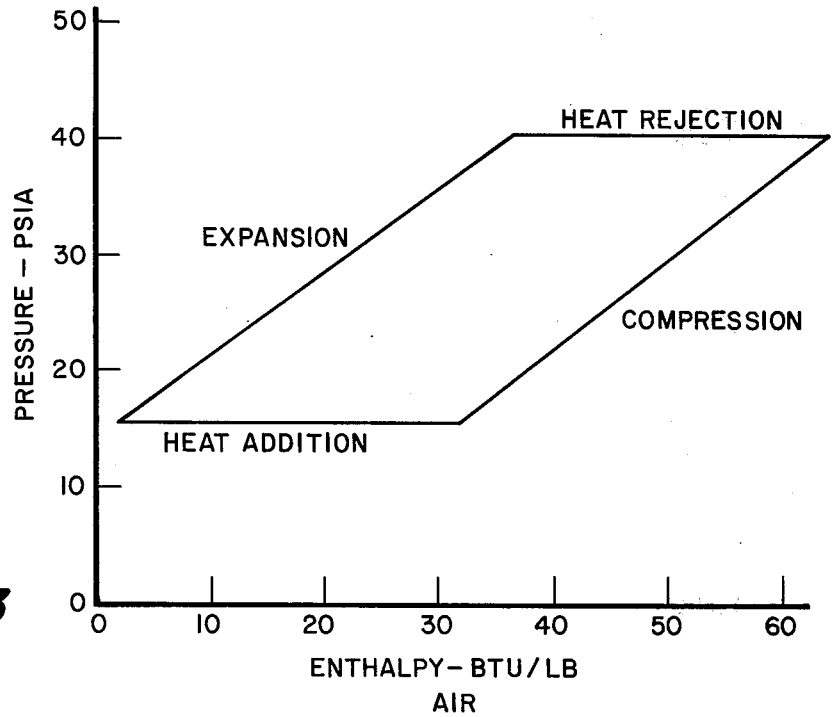
FIG. 3 shows a pressure-enthalpy refrigeration cycle diagram for the device of FIG. 1.
Figure 4:
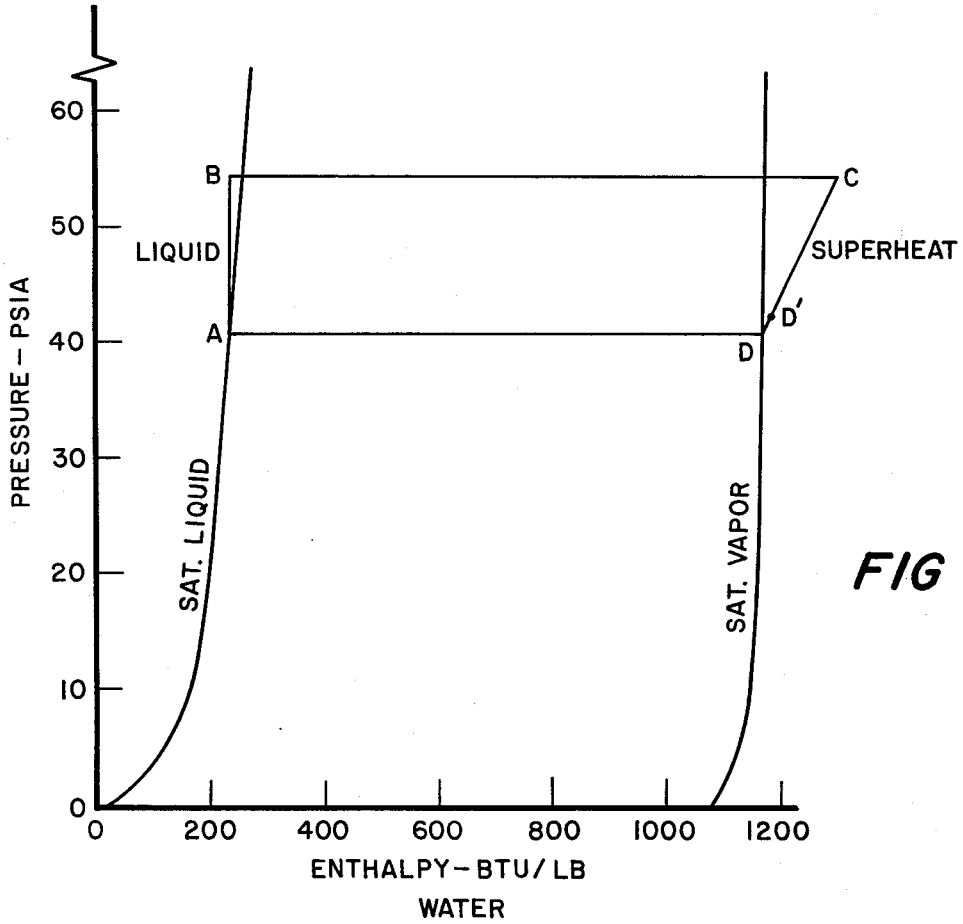
FIG. 4 shows a pressure-enthalpy power cycle diagram for the device of FIG. 1.

The operation of the cooling system 10 is the same as conventional reverse Brayton cycle cooling systems such as described in the U.S. Pat. No. to Edwards, 3,967,466 and as indicated in FIG. 3. With water added as in Edwards, vapor saturated air, at inlet 26 is no longer saturated after being compressed in compressor section 20. The steam from the turbine mixes with the water at the inlet to the heat rejection heat exchanger and is removed as condensate in the heat exchanger 30 and returned to the waste heat recovery system 44 by the pump 46. The turbine drives the rotor 18 through shaft 16. The power cycle is shown in the pressure-enthalpy diagram in FIG. 4 wherein leg AB represents action of pump 46; leg BC represents the heat addition phase in the waste heat recovery system 44; CD′ represents the turbine phase; D′D represents any losses in the line from the turbine to the heat exchanger 30 and DA represents the heat rejection phase.

There is thus provided an air conditioning system for vehicles which makes use of waste heat.

I claim:

1. A compartment cooling system for vehicles driven by an internal combustion engine, comprising: a compressor and an expander driven by a common drive shaft; said compressor having an inlet port and an outlet port; said expander having an inlet port and an outlet port; a turbine connected to said common drive shaft; means for supplying a noncondensible gas to the inlet port of said compressor; a heat rejection heat exchanger connected between the outlet of said compressor and the inlet of said expander; means for supplying a super heated condensible fluid vapor to said turbine; said means for supplying a superheated condensible fluid vapor to said turbine including a vaporizable liquid and means for vaporizing and superheating the vaporizable liquid with waste heat from the internal combustion engine; said turbine having a fluid outlet connected to the outlet of said compressor, means for connecting said vaporizing and superheating means to said heat rejection heat exchanger adjacent the inlet port of said expander.

2. The device as recited in claim 1 wherein the vaporizable liquid is water and the noncondensible gas is air.

3. The device as recited in claim 1 wherein said means for vaporizing and superheating the vaporizable liquid includes means for vaporizing and superheating the vaporizable liquid with exhaust gas from said internal combustion engine.

4. The device as recited in claim 3 wherein said vehicle includes a catalitic converter and said means for vaporizing and superheating the vaporizable liquid includes means for superheating the vaporizable liquid vapor with waste heat from said catalitic converter.

5. The device as recited in claim 4 wherein said means for supplying a superheated condensible fluid vapor to said turbine includes means for heating said liquid with an engine cooler heat exchanger.

6. The device as recited in claim 4 wherein said means for supplying a superheated condensible fluid vapor to said turbine includes means for heating said liquid with an oil cooler heat exchanger.

7. The device as recited in claim 3 wherein said means for supplying a superheated condensible fluid vapor to said turbine includes means for heating said liquid with an engine cooler heat exchanger.

8. The device as recited in claim 7 wherein said means for supplying a superheated condensible fluid vapor to said turbine includes means for heating said liquid with an oil cooler heat exchanger.

9. The device as recited in claim 3 wherein said means for supplying a superheated condensible fluid vapor to said turbine includes means for heating said liquid with an oil cooler heat exchanger.

* * * * *